United States Patent [19]

Haderer et al.

[11] Patent Number: 4,723,675

[45] Date of Patent: Feb. 9, 1988

[54] CONTAINER AND CAP WITH GUARANTEE RING

[75] Inventors: Erwin Haderer, Himberg; Dieter Kohl; Herbert Simmerl, both of Vienna, all of Austria

[73] Assignee: Tuwa-Plastik Dr. Herbert Warnecke Kunststoffverarbeitung, Vienna, Austria

[21] Appl. No.: 895,378

[22] Filed: Aug. 11, 1986

[30] Foreign Application Priority Data

Aug. 22, 1985 [AT] Austria ..... 2459/85

[51] Int. Cl.[4] ..... B65D 41/48

[52] U.S. Cl. ..... 215/253

[58] Field of Search ..... 215/253, 256, 320, 321

[56] References Cited

U.S. PATENT DOCUMENTS

| | | | |
|---|---|---|---|
| 2,772,802 | 12/1956 | Woydatt et al. | 215/256 |
| 3,112,838 | 12/1963 | Studer | 215/256 |
| 3,116,846 | 1/1964 | Salminen | 215/320 |
| 3,974,932 | 6/1976 | Faulstich | 215/256 |
| 4,549,667 | 10/1985 | Dullabaun | 215/253 X |

FOREIGN PATENT DOCUMENTS

| | | |
|---|---|---|
| 311826 | 3/1973 | Austria . |
| 1532389 | 3/1970 | Fed. Rep. of Germany . |
| 1532405 | 3/1970 | Fed. Rep. of Germany . |

*Primary Examiner*—Donald F. Norton

*Attorney, Agent, or Firm*—Nixon & Vanderhye

[57] ABSTRACT

The package is formed of a casing (1) and a closure cap (6). A guarantee ring (7) is connected to the closure plug (6) via tear webs (8). The casing comprises an annular bead (3) beyond which is pressed the guarantee ring (7). A cap-like part (21) of the closure plug (6) has an inwardly protruding annular rim (12). The distance (b) of this annular rim (12) from the bottom of the closure plug is greater than the distance (a) of the annular bead from the edge (2) of the casing. Thus, the guarantee ring (7) as well as the inwardly protruding annular rim (12) can be pressed beyond the annular bead (3). On opening the closure plug, the guarantee ring (7) is torn off the closure plug, but, when again closing the closure plug (6), the closure plug (6) is secured in its closed position by the inwardly protruding annular rim, the inner diameter (13) of which is greater than the inner diameter (9) of the guarantee ring (7).

1 Claim, 3 Drawing Figures

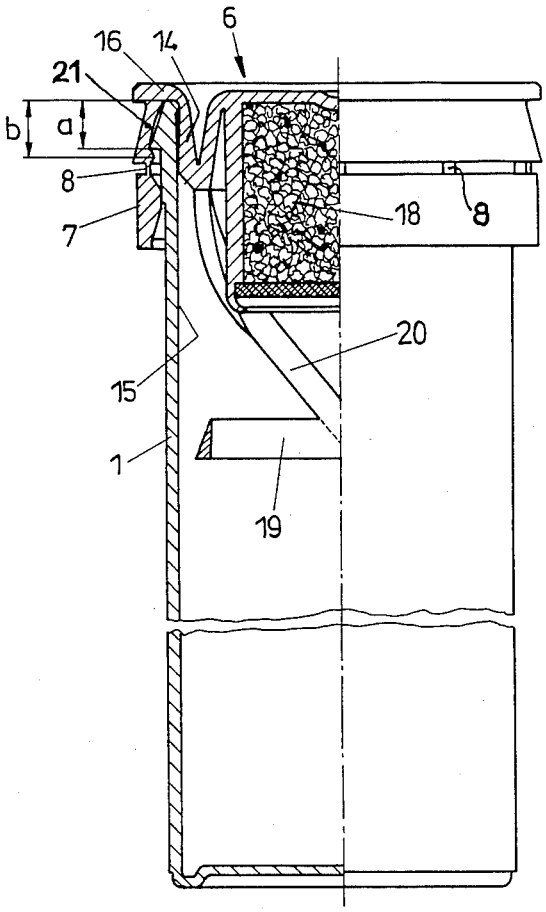
FIG. 1
FIG. 2
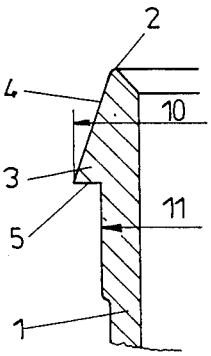
FIG. 3
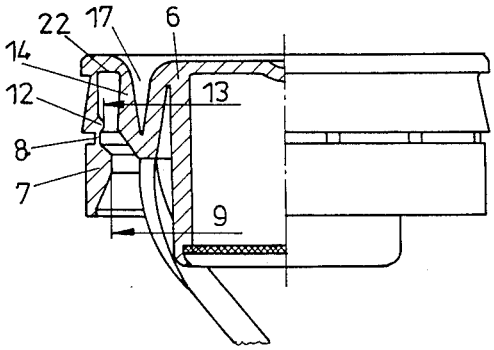

CONTAINER AND CAP WITH GUARANTEE RING

BACKGROUND OF THE INVENTION

1. Field of the Invention

The invention refers to a package consisting of a container formed of a casing being closed on one end and of a closure plug, said plug comprising a part embracing the open edge of the casing like a cap and having connected thereto a guarantee ring via tear webs and said casing comprising an annular bead having an outer diameter exceeding the inner diameter of the guarantee ring, noting that, when closing the container, the guarantee ring is pressed over the annular bead and is thereby elastically expanded. Such a guarantee ring has the advantage that, on opening the package, the tear webs, connecting the guarantee ring with the closure plug, are broken or torn and any unauthorized opening of the closure plug becomes visible, so that this guarantee ring gives a guarantee for an unadulterated content of the package.

2. Description of the Prior Art

In known packages of this type, the guarantee ring provides the hold of the closure plug on the casing, so that, if the package has been opened for the first time and the webs connecting the guarantee ring with the plug have been torn, the plug is unreliably seated on the casing and does not provide a reliable closure for the casing. On account of the guarantee ring being connected with the closure plug only via the tear webs and thus not being tightly connected with the closure plug, a tight seat of the closure plug is not made sure in known packages of this type even prior to the first opening operation of the package.

SUMMARY OF THE INVENTION

It is an object of the invention to tightly connect the closure plug with the casing and to make sure a reliable closure of the package also after the very first opening of the package. For solving this task, the invention essentially consists in that the cap-like part of the closure plug has at least one inwardly protruding protrusion, the distance of said protrusion from the bottom of the cap-like part being greater than the distance of the annular bead from the open edge of the casing and the radial distance of said protrusion from the axis of the closure plug being smaller than the radial distance of the circumference of the annular bead of the casing from the axis of the casing. On account of the distance of the inwardly protruding protrusion from the bottom of the closure plug being greater than the distance of the annular bead from the open edge of the casing, the inwardly protruding protrusion can, when closing the package, be pressed beyond the annular bead of the casing. Thus, this inwardly protruding protrusion of the closure plug is now firmly connected with the closure plug, so that on occasion of opening the closure plug, only the webs are torn which connect the closure plug with the guarantee ring. When again closing the used package, the closure plug can, even if the guarantee ring has already been torn off, be secured in position by the outwardly protruding annular bead of the casing by pressing therebeyond the inwardly protruding protrusion of the closure plug. One or more inwardly protruding protrusions are sufficient for maintaining the closure plug in position if the guarantee ring has been torn off. However, the inwardly protruding protrusion provides the advantage of establishing a tight seal.

According to a preferred embodiment of the invention, the inner diameter of the guarantee ring is smaller than the inner diameter of the inwardly protruding protrusion, being designed as an annular rim, of the cap-like part of the closure plug. Thus, it is made sure, that the guarantee ring can, in case of unauthorized opening of the package, not be pulled over the annular bead of the casing, and, furthermore, the resistance exerted by the inwardly protruding protrusion or, respectively, annular rim is reduced when again opening the already used package.

According to a further preferred embodiment of the invention, the closure plug extends into the interior of the casing and sealingly engages the inner wall of the casing. This provides a second sealing if there is arranged an inwardly protruding annular rim. When providing one or more inwardly protruding protrusions, the closure plug is secured in its position by such protrusions and the tight engagement on the inner wall of the casing is sufficient for establishing a tight seal. According to the invention, the closure plug preferably extends into the interior of the casing at least till the area of the annular bead of the casing, so that the sealing effect is independent of any occasional irregularities of the outer edge of the casing. In this case and according to the invention, the edge of the closure plug is preferably given a Z-shaped cross section, noting that an annular depression is provided between the edge, embracing the edge of the casing, of the closure plug and its body. In this case and according to the invention, the depth of the annular depression conveniently extends till approximately the annular bead of the casing. In this manner, the elasticity of the closure plug is increased and it is made sure that that part of the closure plug, which extends into the interior of the casing, tightly engages the inner wall of the casing.

According to the invention, the inner diameter of the guarantee ring is equal the outer diameter of the casing in the area of the annular bead or, respectively, smaller than said outer diameter. In this manner, a firm seat of the guarantee ring is made sure.

A further preferred embodiment of the invention resides in that the angle included between the annular bead and the outer surface of the casing is greater at that side of the annular bead which faces the open end of the casing than at that side of the annular bead which is turned away from the open end of the casing. In this manner, shifting of the guarantee ring beyond the annular bead is facilitated and a firm seat of the guarantee ring during opening is made sure.

Closing of the package can, if desired, be effected such, that the closure plug comprising the guarantee ring is applied onto the casing in a freshly moulded and thus not completely cooled down condition. In warm condition, the guarantee ring is more easily expandable, so that closing operation can more easily be performed. In spite thereof, a complete protection against unauthorized opening is provided even when subsequently heating the guarantee ring of a closed package, because on heating the guarantee ring, the tear webs are also heated and are thus more easily broken during unauthorized opening.

BRIEF DESCRIPTION OF THE DRAWING

In the drawing, the invention is schematically illustrated with reference to an embodiment.

FIG. 1 shows a partial axial section through a package consisting of a casing and a closure plug.

FIG. 2 shows in an enlarged scale an axial section through the open end,of the casing.

FIG. 3 shows an axial section through the closure plug only.

DETAILED DESCRIPTION OF THE PREFERRED EMBODIMENT

The casing 1 has in proximity of its open end 2 an annular bead 3. The side 4 of the annular bead 3, which faces the open end, includes a great blunt angle with the wall of the casing 1. The side 5 of the annular bead, which is turned away from the open end 2 includes with the wall of the casing 1 an angle of approximately 90°. A guarantee ring 7 is connected with the closure plug 6 via tear webs 8. The inner diameter 9 of the guarantee ring 7 is smaller than the outer diameter 10 of the annular bead 3 and is approximately equal the outer diameter 11 of the casing 1 in the area of the annular bead 3. The inner diameter 9 can be smaller than the outer diameter 11 of the casing in the area of the annular bead 3, so that the guarantee ring contacts the casing under a prestressed condition. The closure plug itself has an inwardly protruding annular rim 12. The inner diameter 13 of this inwardly protruding annular rim 12 is equally smaller than the outer diameter of the annular bead 3, but greater than the inner diameter 9 of the guarantee ring 7.

The distance a between the annular bead 3 and the open edge 2 of the casing 1 is smaller than the distance b between the inwardly protruding annular rim 12 of the cap-like part 21 and a bottom surface, or underside 22 of the closure plug 6. In this manner, not only the guarantee ring 7 but also the inwardly protruding annular rim 12 can be pressed beyond the annular bead 3 when closing the closure plug. On opening of the closure plug 6, the inwardly protruding annular rim 12 is first pulled over the annular bead 3 of the casing 1. Subsequently, the guarantee ring 7 contacts the annular bead 3 and is, on account of this guarantee ring having a smaller diameter, retained by the annular bead 3 and the tear webs 8 are torn.

When again closing the package, in which case the guarantee ring has already been torn off the closure plug 6, the inwardly protruding annular rim 12 is again pressed beyond the annular bead 3, so that the closure plug is firmly seated and the annular bead 3 provides also a sealing area.

The cylindrical part 14 extends into the casing 1 and sealingly engages the inner wall 15 of the casing 1. The cylindrical part 14 extends into the casing 1 till at least the annular bead 3, so that a tight seal is provided in the area of the annular bead 3. This is of some advantage because the outermost edge 2 is most frequently irregularly shaped.

The outer edge portion 16 of the closure plug 6 has a Z-shaped cross section. A groove-like depression 17 is formed between the body of the closure plug 6 and the edge portion 16, said depression extending till the level of the annular bead 3, so that the elasticity of this edge portion 16 is increased and a sealing engagement of the cylindrical part 14 on the inner wall 15 of the casing 1 is reliably obtained.

Reference numeral 18 indicates the usual chamber for accommodating a drying agent. Reference numeral 19 indicates a press pad connected with the closure plug via elastic helices 20 for the tablets contained within the casing.

What is claimed is:

1. A package including a container which comprises a substantially cylindrical casing having at least one open end, and an annular closure cap; said cap being detachably connected to an annular guarantee ring via tear webs which are broken or torn when opening the closure cap, said guarentee ring having inner and outer diameters; said open end of said casing being provided with a single outwardly extending annular bead having an outer diameter larger than the inner diameter of said guarentee ring so that when said guarentee ring is pressed over said annular bead, said guarantee ring elastically expands; said closure cap being formed with an inwardly protruding annular rim which overlaps said outwardly extending annular bead when said closure cap is in place on said casing; wherein said inwardly protruding annular rim has a inner diameter larger than the inner diameter of the guarantee ring but smaller than the outer diameter of said single, outwardly extending annular bead; and wherein the distance between the inwardly protruding annular rim of the closure cap and the underside of said closure cap is larger than the distance between said single annular bead and the open casing end; and wherein when the package is originally closed, the guarantee ring lies in axially spaced relationship to the single annular bead, on that side of said bead which faces away from the open casing and such that, upon upward lifting of the cap, said annular rim of said closure cap is pulled over said annular bead, and said guarantee ring is free to slide upwardly along said cylindrical casing until it engages said annular bead.

* * * * *